United States Patent [19]

Steidle

[11] Patent Number: 4,974,784

[45] Date of Patent: Dec. 4, 1990

[54] WINDING APPARATUS FOR PAPER, TEXTILES OR SYNTHETIC PLASTIC WEBS

[75] Inventor: Gerhard Steidle, Bad Duerrheim, Fed. Rep. of Germany

[73] Assignee: Wild Leitz AG, Heerbrugg/Schweiz, Switzerland

[21] Appl. No.: 421,636

[22] Filed: Oct. 11, 1989

[30] Foreign Application Priority Data

Oct. 14, 1988 [DE] Fed. Rep. of Germany ..... 3835023

[51] Int. Cl.[5] ..... B65H 18/16

[52] U.S. Cl. ..... 242/56 R; 242/67.2; 242/DIG. 3

[58] Field of Search ..... 242/56 R, 65, 66, 67.1 R, 242/67.2, DIG. 3

[56] References Cited

U.S. PATENT DOCUMENTS

| | | | |
|---|---|---|---|
| 1,099,543 | 6/1914 | Fargo . | |
| 2,155,879 | 4/1939 | Washburn et al. | 242/78 |
| 2,551,866 | 5/1951 | Bevins et al. | 242/67.2 |
| 3,498,559 | 3/1970 | Sames | 242/67.2 |
| 4,784,345 | 11/1988 | Romanowski et al. | 242/DIG. 3 X |
| 4,830,304 | 5/1989 | Fuke et al. | 242/67.2 |
| 4,838,497 | 6/1989 | Kramer et al. | 242/67.2 |

FOREIGN PATENT DOCUMENTS

| | | |
|---|---|---|
| 7232971 | 9/1972 | Fed. Rep. of Germany . |
| 2248816 | 4/1974 | Fed. Rep. of Germany . |
| 2737817 | 3/1979 | Fed. Rep. of Germany . |
| 2938865 | 4/1981 | Fed. Rep. of Germany . |
| 2058721 | 4/1981 | United Kingdom . |

*Primary Examiner*—Stuart S. Levy
*Assistant Examiner*—Steven M. duBois
*Attorney, Agent, or Firm*—Foley & Lardner, Schwartz, Jeffery, Schwaab, Mack, Blumenthal & Evans

[57] ABSTRACT

A winding apparatus for winding webs of paper, textile fabric, synthetic plastic material or other similar webs into tight rolls comprising a winding chamber having an inlet opening at the top and a pair of drive rollers for frictionally driving a roll of material arranged at the bottom, substantially diametrically opposite the inlet opening. One side of the winding chamber is defined by concave surfaces of a plurality of parallel wall elements, and the other side of the winding chamber is defined by a pivotally mounted shell body. In preferred embodiments, alternate devices for fastening a wound roll with an adhesive strip are disclosed. The winding apparatus of the invention can be manufactured at reasonable cost, does not require excessive space, and functions with a high degree of reliability.

17 Claims, 3 Drawing Sheets

WINDING APPARATUS FOR PAPER, TEXTILES OR SYNTHETIC PLASTIC WEBS

BACKGROUND OF THE INVENTION

The invention relates to a winding apparatus for paper, textiles or other material webs of easily windable material to produce a round wound roll with a motor driven, roller-like winding device, by means of which the resulting wound roll is frictionally driven rotationally, wherein a length device is provided in front of the winding roll in the feed-in direction for severing the material web and a transport device comprising at least one pair of transport rollers is arranged in front of the length device, and wherein the circumferential speed of the winding device is greater than the transport speed of the material web.

A device for winding up paper, corrugated cardboard, textiles and/or synthetic plastic webs or the like is already known from German patent application No. DE-OS 27 37 817 in which at least three winding rollers are provided arranged on pivoting levers with axes parallel to the longitudinal axis of the roll to be formed. These winding rollers are adjustable by means of their pivot levers against spring pressure in a radial direction with respect to the longitudinal axis of the roll to be formed. The pivot levers are so coupled to each other that their adjustment lengths in each case are at least approximately equal in size, so that they thus move away uniformly in the radial direction from the longitudinal axis of the roll to be formed. At least one of the winding rollers is provided with its own drive, by means of which the roll is made to turn. The winding rollers form a circular shell which increases in size in accordance with the increase in diameter of the roll. Aside from the fact that this device requires a lot of space for the mounting and housing of the winding rollers mounted on the movable pivot levers and also is very expensive in terms of manufacturing cost, because the winding rollers rotate in the same sense or direction, they cannot be brought so close together that two of these rollers contact each other. This raises the danger, however, that at the beginning of the formation of a roll, the forward end section of the paper web introduced between the winding rollers unintentionally passes outwardly again between two other rollers so that no roll is formed unless additional devices or means are provided which favor the formation of a roll core.

SUMMARY OF THE INVENTION

It is the object of the invention to provide a winding apparatus of the afore described type which has a simple and compact construction, consists of few parts, in which the core-free formation of a roll is sure to occur automatically without the assistance of supplemental means and also without disturbances both at small and also at larger roll winding diameters, and with which the ejection of the completed wound roll can be managed automatically in a simple manner.

This object is achieved in accordance with the invention by providing a winding apparatus for forming a roll comprising a substantially circular winding chamber with a slit-like inlet opening and with a segmental winding device projecting into the winding chamber approximately diametrically opposite the inlet opening, wherein the winding chamber comprises a circumferential section constructed of fixed, concave surfaces and a circumferential section formed by a pivotably mounted shell body which encloses at least half the circumference of the winding chamber.

The particular advantage of the winding apparatus according to the invention lies in its simple, space-saving construction and in that only a single winding device is required. In addition, it is also of advantage that the pivotably mounted shell body, on the one hand, defines a boundary of the winding chamber which reliably leads to formation of a roll and, on the other hand, likewise facilitates growth of the roll winding diameter as well as the opening of the winding chamber for discharging the completed wound roll.

While it is fundamentally possible to arrange the inlet opening at any desired point on the periphery of the winding chamber, the arrangement in which the inlet opening is arranged at the top of the winding chamber and the winding device is arranged at the bottom of the winding chamber at least approximately in the same vertical plane as the center of the winding chamber has the advantages that the wound roll lies with its weight on the winding device so that no supplemental devices are needed to press the roll against the winding device, and that the completed wound roll falls out of the winding chamber when the shell body is lifted up, preferably automatically, to open the winding chamber.

The embodiment in which the shell body encloses the circumferential section of the winding chamber which extends in the winding direction from the inlet opening to the winding device ensures that an opening of the winding chamber can be achieved which is wider than its diameter, i.e. wider than the diameter of the wound roll, with a shell body pivot angle which is less than 90 degrees.

Although it is fundamentally conceivable to arrange the pivot axis of the shell body underneath the winding chamber, the arrangement in which the shell body is pivotable around the axis of a pivot shaft which is arranged above the winding chamber inlet opening has the advantage that the shell body is held in the closed position by its own weight, but that on the other hand, it is relatively easily pivotable in the opening direction so that it does not present any restrictive resistance to the increasing diameter of the roll. Additionally, this arrangement has the advantage that the shell body does not hinder the discharge of the wound roll.

This advantage is reinforced further by the embodiment in which the axis of the pivot shaft is arranged at least approximately in the same vertical plane as the center of the winding chamber.

An especially simple configuration of the shell body is produced in the embodiment in which the shell body comprises a substantially semicircular, thin-walled synthetic plastic shell having a smooth inner surface.

The embodiment of the invention in which the pivotable shell body is arranged behind the inlet opening in the feed-in direction yields the advantage that the finished wound roll can roll out of the opened winding chamber in the winding direction, e.g. onto an outwardly and downwardly inclined receiving table provided underneath the shell body, without opening up during the discharge operation.

The embodiment in which the fixed concave surfaces have an inner radius of curvature which is from about 1/10 to 1/5 smaller than the inner radius of curvature of the shell body makes it possible that soon after the wound roll is started, e.g. when it comprises only 2 or 3 windings, it no longer has large surfaces in frictional contact with the concave surfaces.

The embodiment in which the center of curvature of the concave surfaces and the center of curvature of the shell body are vertically spaced from each other and lie at least approximately in the same vertical plane as the center of the winding chamber leads in conjunction with the embodiment in which the fixed concave surfaces have an inner radius of curvature which is from about 1/10 to 1/5 smaller than the inner radius of curvature of the shell body to the result that the wound roll which forms assumes an approximately concentric or only slightly eccentric position relative to the center of the winding chamber.

The embodiment in which the concave surfaces end in upper end segments which are spaced from the vertical plane of the center of the winding chamber a distance which corresponds to at least one-fourth the radius of curvature of the concave surfaces leads to the result that as the diameter of the wound roll increases, the roll is displaced in the discharge direction and that the maximum diameter of the wound roll may be made larger than the initial width of the winding chamber without any difficulty.

While the embodiment in which the shell body is pivotable into an open position by means of a motorized drive makes possible an automatic or program-controlled opening of the winding chamber in a simple manner at the end of the winding operation, the embodiment in which the shell body is mounted by means of a free-wheel drive on a pivot shaft which is motor drivable in the opening direction to facilitate radial opening of the shell body has the advantage of easy opening of the shell body which can also be effected manually.

The embodiment in which the winding device is driven at a circumferential speed which is at least 1.2-fold as large as the feeding speed of the pair of transport rollers makes certain that the wound roll assumes a smaller initial diameter than the smallest internal diameter of the winding chamber and that a tightly (solidly) wound roll results.

The embodiments in which the winding device comprises a plurality of uniformed diameter roller-like or disk-like winding rollers fixed to a common winding shaft at uniform axial spacings and in which the fixed portion of the winding chamber is formed from a plurality of wall elements arranged between the winding rollers, the wall elements being provided with arcuate recesses which form the concave surfaces that define the contour of the fixed portion of the winding chamber result in an easy and economical construction, particularly when the winding rollers or the wall elements are constructed of synthetic plastic material.

With the aid of the embodiments in which an adhesive strip for adhering the end segment of the material web to the wound roll is supplied to a roller-like winding roller or to a pressure roller arranged on the winding shaft between two winding rollers; in which the adhesive strip comprises an adhesive film which is transferred to the wound roll from a smooth carrier tape which is guided around the pressure roller, and in which the adhesive strip in the form of a paper synthetic plastic ribbon with an adhesive layer adhered to one side thereof is supplied through a cutting device to the point of contact between the wound roll and a roller-like winding roller or the pressure roller by means of a separately drivable pair of transport rollers, it is possible to fasten the free end of the finished wound roll to the roll circumference in a simple manner by means of an an adhesive strip so that the roll is prevented from opening up as it is discharged from the winding chamber.

BRIEF DESCRIPTION OF THE DRAWINGS

The invention will explained in further detail hereinafter with reference to the accompanying drawings, wherein.

DETAILED DESCRIPTION OF PREFERRED EMBODIMENTS

Figure 1:
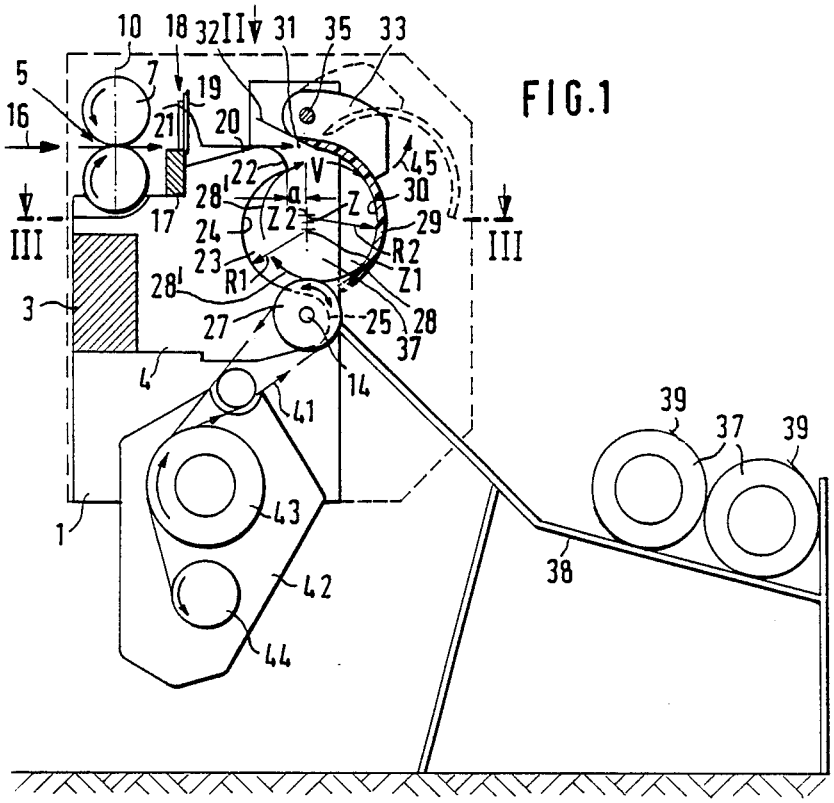
FIG. 1 is a simplified sectional view of a winding apparatus according to the present invention.

The winding apparatus illustrated in the drawing comprises a carrier rail 3 with a square profile extending between two frame plates 1 and 2, on which carrier rail, in addition to the frame plates 1 and 2, a plurality of wall elements 4 extending perpendicularly thereto are fastened at regular intervals. Above the carrier rail 3 and also above the wall elements 4 a pair of transport rollers 5, comprising a drive roller 6 and a pressure roller 7 is arranged, the shafts 8 and 9 of which are rotatably mounted in a vertical plane 10 in the two frame plates 1 and 2. The shaft 8 is provided on the outside of the frame plate 1 with a toothed belt gear 11 which is connected by a toothed belt (not shown) with a drive motor (also not shown) and is driven by the drive motor. On the outside of frame plate 2 the shaft 8 of the drive roller 6 is provided with a further tooth belt disk which is in engagement via a toothed belt 13 with a toothed belt disk 15 rotationally secured to a winding shaft 14. In conjunction with an adhesive band feeding device described in further detail hereinafter, it may, however, be more advantageous for the winding shaft 14 to be provided with its own drive motor. The arrangement of the pair of transport rollers 5 is done in such a way that the fabric webs or paper webs, which are supplied from some type of processing machine, for example a printing press or an automatic marking machine, and are transported between the pair of transport rollers 5 in the direction of the arrow 16, run across a cutting rail 17, which is part of a length cutting device 18 and above which a rotatably mounted cutting disk 19 can be guided. The cutting rail 17 is fastened in both of the frame plates 1 and 2 and simultaneously also to the wall elements 4 which extend from the carrier rail 3 in the feed-in (transport) direction 16 and serves as a counter element for the cutting disk 19 which is moved across the entire length of the cutting rail 17 by means of a special drive (not shown here) in order to cut off a web of material being supplied.

On the side of the cutting rail 17 opposite the pair of transport rollers 5 the wall elements 4 are each provided with guide projections 20 which extend upwardly to the inlet level 21 of the web of material and which end with a circular-form, downwardly extending end section 22. On the end faces turned away from the carrier rail 3, the wall elements 4 are each provided with circular-form segments 23, the concave surfaces 24 of which are smooth and extend substantially over the length of a semi-circle, and at the top in an end section 22 and transition at the bottom into a rounded mounting eye 25. In these mounting eyes 25 of the individual wall elements 4 as well as in the two frame plates 1 and 2 a continuous, motor-driven winding shaft 14 is mounted, on which small, plate-like winding rollers 27 are rotationally secured in regular intervals on both sides of a wall element 4, which winding rollers 27 extend from underneath segmentally into a winding chamber 28 and which are placed in rotational motion together by the winding shaft in the counter-clockwise direction with reference to FIGS. 1 and 4. The winding chamber is bounded on the one side by the concave surfaces 24 of the recesses 23 of the wall elements 4 and on the other side by a shell body 29 which lies opposite the concave surfaces 24, which shell body consists of a thin-walled shell of synthetic plastic material having a semi-circular profile with a smooth inner surface 30, and which preferably extends at least substantially over the entire length of the winding chamber 28 bounded by the two frame plates 1 and 2.

Figure 4:
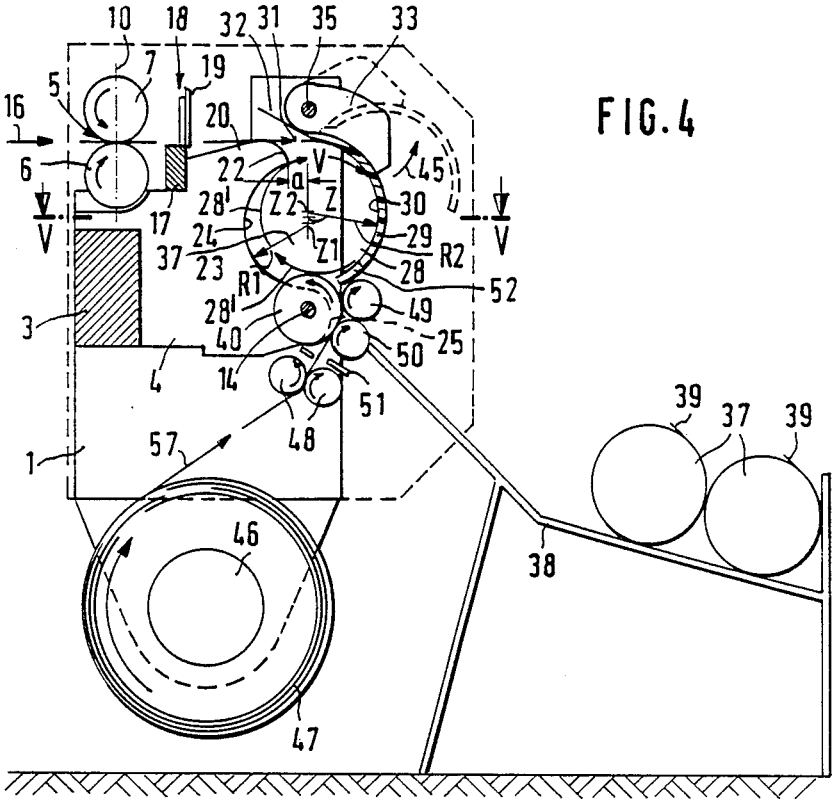
FIG. 4 is a simplified sectional view of a winding apparatus with an alternate adhesive strip feeding device.

As can be seen from FIGS. 1 and 4, the concave surfaces 24 with their center of curvature Z1 have an inner radius of curvature R1 which is about $\frac{1}{8}$ smaller than the inner radius of curvature R2 of the shell body 29, the center of curvature Z2 of which preferably disposed in the same vertical plane as Z1 and as the center Z of the winding chamber 28 which lies between Z1 and Z2. The size difference between R1 and R2 may range from 1/10 to 1/5 of R2.

It is also important to the function of the apparatus that the end section 22, which bounds the concave surface 24 at its upper end, is spaced from the vertical plane V, which lies in the center of the winding chamber, a distance which is at least equal to, or is larger than, $\frac{1}{4}$ of the radius of curvature R1 of concave surfaces 24.

This measure assures that a wound roll forms with low friction and free of disturbances up to a maximum diameter which can be substantially larger than the initial width of the winding chamber 28. Soon after it is initially formed, the wound roll contacts the upper end of the concave surface 24 only along a single line and with only minimal pressure. The area of contact between the wound roll and the shell body 29 also becomes smaller and is subject to lower pressure as the roll diameter increases, so that optimum conditions prevail for the formation of a wound roll. The winding rollers 27 advantageously are formed of a material with a high coefficient of friction, such as, for example, rubber or the like, or they are provided with a friction jacket of such material, and as a functional unit they form a single (i.e. the only) winding device.

As can be seen from FIGS. 1 and 4, the shell body 29 extends from an inlet opening 31, which is arranged at the top of the winding chamber 28 diametrically opposite the winding rollers 27, around half the circumferential section of the substantially circular winding chamber 28 down to the vicinity of the winding rollers 27. The upper end of the shell body 29 is positioned at the height of the inlet plane 21 and is provided with a guide sheet 32 which extends upwardly at an angle. The shell body 29 is attached to at least two supports 33 arranged at its ends, only one of which is visible in FIGS. 1, 2 and 4, and which each are mounted by means of a freely moving (free-wheeling) sleeve 34 on a pivot shaft 35. The pivot shaft 35 is rotatably mounted in the two frame plates 1, 2 above the inlet opening 31 and consequently is diametrically opposite the winding shaft 14, and is provided on the outside of the frame plate 1 with a toothed belt sheave 36 which is connected in driving engagement with a separately controllable drive motor (not shown) by a toothed belt (likewise not shown).

The two freely moving (free-wheeling) sleeves 34 are arranged in such a way that the two supports 33 with the shell body 29 are freely pivotable in the opening direction of arrow 36, so that as a wound roll is formed, the width of the winding chamber 28 can increase in size by means of an appropriate upward movement of the shell body 29 without encountering great resistance. With this arrangement of the freely moving sleeves 34, it is also possible, on the other hand, to pivot the shell body 29 into the open position illustrated by broken lines in FIGS. 1 and 4 by turning the pivot shaft 35 in the direction of arrow 45 by means of a drive motor (not shown) so that a wound roll 37 in the winding chamber 28 which has already been severed from the incoming material web by length device 18, can fall out of the winding chamber 28 and roll onto an outwardly and downwardly inclined receiving table 38.

In the closed position of the shell body 29 illustrated in FIGS. 1 and 4, the shell body together with the concave surfaces 24 of the recesses 23 of the individual wall elements form the boundaries of a substantially circular winding chamber 28 approximately concentric with a center Z. The winding chamber is provided at its top with the inlet opening 31 and at its bottom, diametrically opposite the inlet opening, with the winding rollers 27 which are affixed to the common winding shaft 14 and project segmentally into the winding chamber 28 and constitute the actual winding device. The winding shaft 14 with the winding rollers 27 thereby forms the motor driven winding device which rolls up the leading end of the material web which enters through the inlet opening 31 into the winding chamber 28 and passes in bent form along the inner surface 30 of shell body 29 in the direction indicated by the arrow 28' to the winding rollers 27 to form a wound roll 37 in the winding chamber 28. In order to obtain a wound core diameter, on the one hand, which is smaller than the inner width of the closed, empty winding chamber 28, and in order, on the other hand, to achieve a tight contact of the roll windings, the winding rollers 27, which are in driving frictional engagement with the incoming material web (i.e. with the outer surface of the wound roll 37) are driven at a circumferential speed which is from about 1.2-fold to 1.5-fold or more times the transport speed of the incoming web determined by the pair of transport rollers 5. This difference in speed can be achieved by means of a corresponding transmission ratio or by using winding rollers 27 with a larger diameter compared to the drive rollers 6, with which the winding shaft 14 is in driving engagement via toothed belt 13 as previously described.

Arranging the winding rollers 27 substantially vertically underneath the winding chamber center Z, i.e. underneath the inlet opening 31, leads to the result that the growing wound roll lies with its full weight on the winding rollers 27 and that after it is severed from the incoming web of material, it falls by itself out of the winding chamber 28 when the shell body 29 is opened.

As shown in FIG. 1, it is advantageous to provide the shell body 29 with a larger radius of curvature than that of the concave surfaces 24. This has the result that the increasingly growing wound roll 37 no longer contacts the concave surfaces 24 and only contacts a small surface of the shell body 29, so that only minimal frictional resistance needs to be overcome to rotate the wound roll.

When the wound roll is completed, the transport of the incoming material web is stopped. The material web is severed from the wound roll 37 by means of the cutting disk 19 which is then drawn along the cutting rail 17. The end section of the material web is then wound up on the wound roll 37 by a brief actuation of the winding roll 14 while the pair of transport rollers 5 is stopped or moved out of engagement with each other. After this is completed, then by actuating the separate motor which drives the pivoting shaft 35, the shell body 29 can be pivoted sufficiently far that the completed wound roll 37 rolls onto the receiving table 38 as illustrated in FIGS. 1 and 4. Since the completed wound roll 37 rolls out from the winding chamber 28 with the same direction of rotation it has during winding of the wound roll 37, it is also ensured that the completed wound roll 37 remains closed or springs open only slightly. This is due to the fact that the shell body 29, which can be pivoted into an open position, is arranged behind the inlet opening 31 in the feed-in direction and that the receiving table 38 is also arranged on the opposite side of the winding chamber from the pair of transport rollers 5.

After turning off the motor drive, the shell body 29 falls due to its own weight back into the closed position.

With the aforedescribed winding apparatus it is also readily possible to wind oversized wound rolls, the diameters of which exceed the capacity of the winding chamber 28. When an oversized wound roll is to be wound, the shell body 29 remains closed until the beginning of the roll has achieved a sufficient stability, i.e. approximately 2 to 3 windings. Then the shell body 29 is pivoted into its open position so that it does not hinder the further growth of the wound roll.

Depending on the nature of the materials from which the material web is formed, it may also be necessary, or at least advantageous, to fasten the outer end section 38 of the wound roll 37 to the circumference of the roll with a suitable means before the roll is discharged from the winding chamber 28. The invention contemplates two different devices for this purpose, which are illustrated in FIGS. 1 and 3 or FIGS. 4 and 5.

In both embodiments, a pressure roll 40 which has the same diameter as the winding rolls 27 is fixedly arranged fixed on the winding shaft 14 in the longitudinal center between two wall elements 4 and two winding rolls 27.

Figure 3:
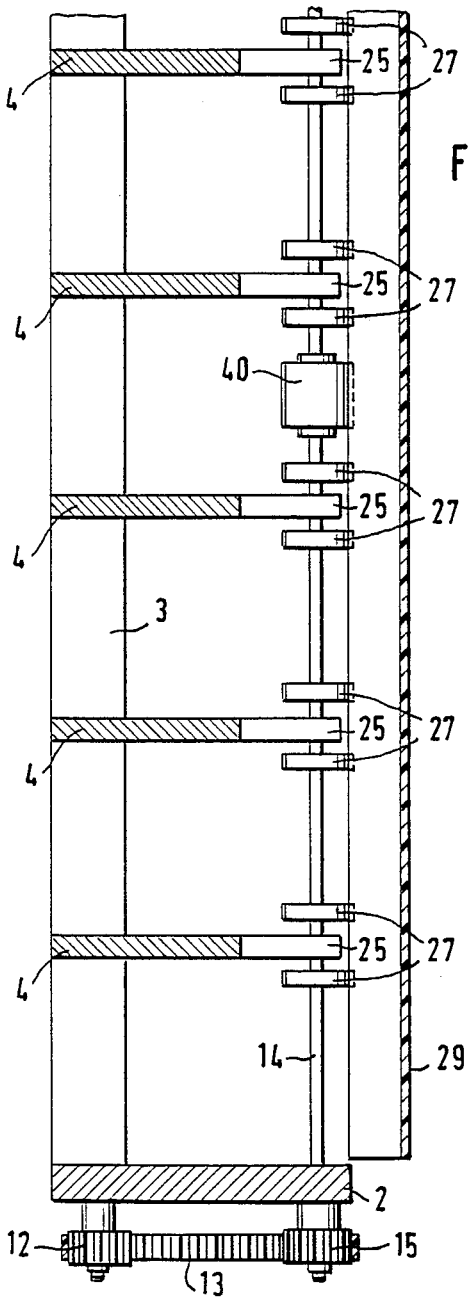
FIG. 3 is a partial sectional view of the apparatus taken along line III—III of FIG. 1.

In the embodiment of FIGS. 1 and 3, a carrier tape 41 coated with an adhesive film, which can be pulled off, is guided over the pressure roll 40 shown in FIG. 3. The tape 41 unwinds from a supply roll 43 rotatably arranged in a cassette 42 and is wound up again on a winding post 44. The adhesive film is thereby disposed on the outer surface of the smooth carrier tape 41 so that it comes in contact with the end section 39 or with the circumference of the wound roll 37 when it is guided around the circumference of the pressure roll 40. The feeding takes place by means of a drive arrangement (not shown in further detail) of the winding post 44 which draws the carrier tape over the pressure roll 40. The operation of this drive is controlled in such a way that when the end section 39 severed by the length device 18 approaches the pressure roll 40, the upper end section adhesive film, which is disposed on the carrier tape, is pressed against the outer surface of the approaching end section 39 by an appropriate forward movement of the carrier tape 41, and thereafter is also adheringly applied to the circumferential section of the wound roll 37 which follows the end section 39. Then the drive of the winding post 44 is stopped and the supply roll 43 is also brought to a stop or caused to make a slight backward movement while the winding rollers 27 continued to turn. The thin adhesive film is thereby torn off. The torn end of the adhesive film which remains on the carrier tape 41 is then pulled away again from the point of contact between the pressure roller 40 and the wound roll 37 by the brief backward movement of the supply roll 43, so that the adhesive film does not interfere with the following winding operation.

Figure 5:
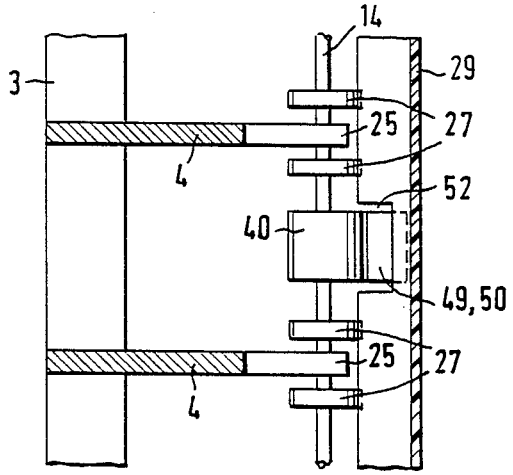
FIG. 5 is a partial sectional view of the apparatus of FIG. 4 taken along line V—V.

In the device illustrated in FIGS. 4 and 5, a roll of adhesive tape 47 is mounted on a mounting post 46 underneath the winding device. This adhesive tape 57 comprises a paper or synthetic plastic ribbon which is provided on one side with a layer of adhesive and which is supplied to the pressure roller 40 by a pair of transport rollers 48 arranged underneath the winding rollers 27. The pressure roller 40 is provided with two guide rollers 49 and 50 which are resiliently biased into contact therewith. Between the pair of transport rollers 48 and the pressure roller 40, a cutting device 51 is arranged which serves to sever the tape sections which are required to firmly adhere the adhesive tape sections 39 to the circumference of the individual wound rolls 37.

So that the guide roller 49 does not interfere with the outward pivoting of the shell body 29, the shell body is provided with a cutout 52 in the vicinity of the guide roller 49.

At the end of a winding operation, as the end section 39 approaches the pressure roller 40, the pair of transport rollers 48 is drivingly engaged. This transports the upper end of the adhesive tape 57 between the guide rollers 49, 50 and the pressure roller 40 so that it is initially pressed against the end section 39 and thereafter onto the following circumferential section of the wound roll 37. However, as soon as the leading edge of the adhesive tape 57 reaches the point of contact between the wound roll 37 and the pressure roller 40, the cutting device 51 is actuated. The pair of transport rollers 48 is simultaneously stopped.

With both adhesive tape supply devices it is necessary that the forward movement of the material web through the pair of transport rollers 5 be interrupted after the wound roll is cut off for a sufficient time until the completed wound roll 37 has been discharged from the winding chamber 28 and the shell body 29 has again assumed its closed position, so that the start of the following wound roll 37 does not come into contact with the adhesive tape of the just completed wound roll 37. If instead of the disk-like winding rollers 27, roller-like winding devices are arranged on the winding shaft 14 between the individual wall elements 4, it is also possible with the embodiment of FIGS. 4 and 5 to guide the adhesive tape 57 directly around such a roller-form winding device if this roller-form winding device is provided with one or two guide rollers 49, 50 in a manner analogous to pressure roller 40.

Figure 2:
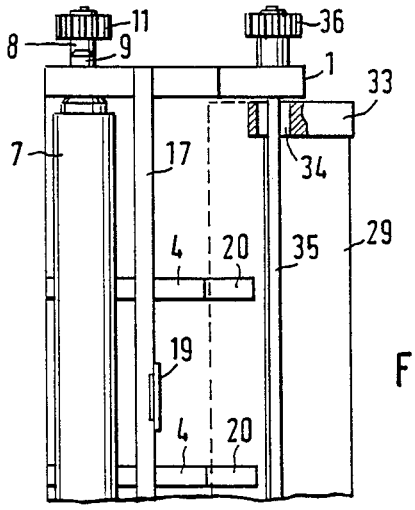
FIG. 2 is a partial view of the apparatus viewed in the direction of arrow II of FIG. 1.

The manner of operation of the winding apparatus illustrated in FIGS. 4 and 5 is otherwise the same as that of the embodiment illustrated in FIGS. 1, 2 and 3.

The foregoing description has been set forth merely to illustrate the invention and is not intended to be limiting. Since modifications of the described embodiments incorporating the spirit and substance of the invention may occur to person skilled in the art, the scope of the invention should be limited solely with reference to the appended claims and equivalents.

What is claimed is:

1. A winding apparatus for a web of readily windable material to form a round wound roll comprising: at least one motor driven, roller-like winding member mounted on a single, common winding shaft for frictionally driving a roll being wound to rotate it; a cutting device disposed upstream of said at least one winding member in the transport direction for severing said web, a transport device for transporting said web comprising at least one pair of transport rollers arranged upstream of said cutting device, a substantially circular winding chamber having a slit-like inlet opening arranged at the top thereof, said at least one winding member being arranged at the bottom of said winding chamber at least approximately in the same vertical plane as the center of the winding chamber approximately diametrically opposite said inlet opening and projecting into the winding chamber so that a roll being wound in said winding chamber will lie with its weight resting on said winding member, said winding chamber comprising a fixed circumferential section defined by fixed, concave surfaces and a pivotable circumferential section defined by a pivotable shell body outwardly pivotable around the axis of a pivot shaft arranged above said inlet opening, said shell body enclosing a substantially semicircular circumferential section of said winding chamber extending in the direction or winding from said inlet opening to said winding member.

2. A winding apparatus according to claim 1, wherein the axis of said pivot shaft is arranged at least approximately in the same vertical plane as the center of the winding chamber.

3. A winding apparatus according to claim 1, wherein said shell body comprises a thin-walled synthetic plastic shell having a smooth inner surface.

4. A winding apparatus according to claim 3, further comprising a downwardly and outwardly inclined receiving table arranged underneath said shell body.

5. A winding apparatus according to claim 1, wherein said pivotable shell body is arranged downstream of said inlet opening in the transport direction of the web.

6. A winding apparatus according to claim 1, wherein said fixed, concave surfaces have an inner radius of curvature which is from about 1/10 to about 1/5 smaller than the inner radius of curvature of said shell body.

7. A winding apparatus according to claim 6, wherein said fixed, concave surfaces and said shell body have respective centers of curvature, and the centers of curvature of the fixed concave surfaces and of the shell body are vertically spaced from each other and lie at least substantially in the same vertical plane as the center of the winding chamber.

8. A winding apparatus according to claim 1, wherein said fixed, concave surfaces end in upper end segments which are spaced from the vertical plane of the center of the winding chamber a distance at least equal to one-fourth of the radius of curvature of said fixed, concave surfaces.

9. A winding apparatus according to claim 1, further comprising motorized drive means for pivoting said shell body into an open position.

10. A winding apparatus according to claim 9, wherein said shell body is mounted by means of a free-wheel drive on a pivot shaft which is motor drivable in the opening direction to facilitate radial opening of the shell body.

11. A winding apparatus according to claim 1, wherein said winding device is driven at a circumferential speed which is at least 1.2-fold as large as the speed at which a web is transported by said transport device.

12. A winding apparatus according to claim 1, wherein said winding device comprises a plurality of uniform diameter, roller-like or disk-like winding rollers fixed to a common winding shaft at uniform axial spacings.

13. A winding apparatus according to claim 1, wherein said winding members are winding rollers, and said fixed circumferential section of the winding chamber comprises a plurality of wall elements arranged between said winding rollers, said wall elements being provided with arcuate recesses which form said fixed, concave surfaces, thereby defining the contour of the winding chamber.

14. A winding apparatus according to claim 1, further comprising means for supplying an adhesive strip for adhering an end segment of a web of material to a wound roll formed therefrom, to a roller-like winding member arranged on the winding shaft.

15. A winding apparatus according to claim 14, further comprising a separately drivable pair of transport rollers for supplying an adhesive strip in the form of a paper or synthetic plastic ribbon having an adhesive layer adhered to one side thereof to a point of contact between the wound roll and said pressure roller, and a cutting device arranged adjacent said adhesive strip for cutting said strip.

16. A winding apparatus according to claim 1, further comprising a pressure roller arranged on said winding shaft between two winding rollers, and means for supplying an adhesive strip for adhering an end segment of a web of material to a wound roll formed therefrom, to said pressure roller.

17. A winding apparatus according to claim 16, wherein said adhesive strip comprises an adhesive film which is transferred to the wound roll from a smooth carrier tape which is guided around said pressure roller.

* * * * *